United States Patent [19]

Fairbanks

[11] 4,169,726

[45] Oct. 2, 1979

[54] CASTING ALLOY AND DIRECTIONALLY SOLIDIFIED ARTICLE

[75] Inventor: Norman P. Fairbanks, Cincinnati, Ohio

[73] Assignee: General Electric Company, Cincinnati, Ohio

[21] Appl. No.: 862,782

[22] Filed: Dec. 21, 1977

[51] Int. Cl.[2] ..... C22C 19/07

[52] U.S. Cl. ..... 75/134 F; 75/171; 415/212 A; 428/678

[58] Field of Search ..... 75/134 F, 171; 148/34; 428/678; 415/212 R, 212 A

[56] References Cited

U.S. PATENT DOCUMENTS

| | | | |
|---|---|---|---|
| 3,418,111 | 12/1968 | Herchenroeder | 75/171 |
| 3,582,320 | 6/1971 | Herchenroeder | 75/171 |
| 3,591,371 | 7/1971 | Hatwell | 75/171 |
| 4,080,202 | 3/1978 | Fukui et al. | 75/171 |

*Primary Examiner*—M. J. Andrews

*Attorney, Agent, or Firm*—Lee H. Sachs; Derek P. Lawrence

[57] ABSTRACT

An improved Ni-Co-Cr base casting alloy is particularly useful as a directionally solidified article in the form of a gas turbine blade tip portion to provide resistance to the combination of oxidation, sulfidation and thermal fatigue at elevated temperatures. The alloy base is enhanced through the alloying additions of Ta, Al, W, C, Si and optionally La.

6 Claims, No Drawings

CASTING ALLOY AND DIRECTIONALLY SOLIDIFIED ARTICLE

BACKGROUND OF THE INVENTION

This invention relates to casting alloys particularly useful in directional solidification and, more particularly, to such an alloy structure useful in the tip portion of gas turbine engine blades.

During operation of axial flow turbine engines, for example gas turbine engines, very close tolerances are maintained between the tips of blading members and opposed cooperating members assembled in a type of gas seal. Such a seal is intended to inhibit leakage of gas, for example compressed air or combustion products, about the blade tips. Because of the difference in rates of thermal expansion of such cooperating members, interference between rotating and stationary parts can occur. This problem is more difficult in the turbine portion of the engine because of the higher temperatures experienced. In addition, because of such elevated temperatures, oxidation resulting from the presence of air and sulfidation resulting from airborne corrosive compounds such as sea salt further complicate the problem. As a result, a variety of coatings for gas turbine blades have been developed and reported. However, during interference between a rotating and a stationary component in the turbine of such an engine, the coating is rubbed away at the blade tip exposing the alloy to oxidation and sulfidation. In general, nickel-base superalloys possess good oxidation properties and relatively poor corrosion or sulfidation resistance. Conversely, cobalt-base superalloys used for such turbine blades generally possess good sulfidation or corrosive properties but poorer oxidation resistance. Accordingly, there is a need for a turbine blade tip alloy capable of long life in both oxidation and corrosive atmospheres.

SUMMARY OF THE INVENTION

It is an object of the present invention to provide an improved casting alloy of a composition which provides a combination of oxidation and corrosion or sulfidation resistance while providing adequate strength for use as a turbine blade tip.

It is another object to provide a directionally solidified structure of such an alloy which can be used as a turbine blade tip for gas turbine engines.

These and other objects and advantages will be more fully understood from the following detailed description and examples, all of which are intended to be typical of rather than in any way limiting on the scope of the present invention.

The improved casting alloy associated with the present invention and which has the capability of providing resistance to oxidation, corrosion and thermal fatigue, consists essentially of, by weight, 32–34% Ni, 32–34% Co, 22–24% Cr, 2.5–3.5% Ta, 3.5–4.5% Al, 2.5–3.5% W, 0.4–0.5% C, 0.6–0.9% Si and up to 0.1% La, along with incidental impurities. As a cast article, it is particularly useful in a directionally solidified structure, preferably a single crystal structure, and as a tip secured to the balance of a turbine blade.

DESCRIPTION OF THE PREFERRED EMBODIMENTS

In the evaluation of the present invention, it was recognized that strengths needed at turbine blade tips are lower than are required of the structure of the balance of the turbine blade. Thus, the very high mechanical properties required in the body of turbine blades are not required in turbine blade tips. Important to such tip materials or structures are resistance to oxidation, corrosion and thermal fatigue. Therefore, one characteristic of the article or structure associated with the present invention is the fact that it is in the directionally solidified condition, preferably as a single crystal structure.

During the evaluation of the present invention, a variety of alloy compositions, some of which are commercially available, were tested for high temperature mechanical properties, for example at 2000° F., as well as for resistance to oxidation and corrosion at temperatures of at least 1700° F. and as high as about 2100° F. The following Table I presents typical examples of alloys evaluated in this manner.

TABLE I

| Alloy Ex. | Nominal Composition (Wt. %) | | | | | | | | | | | | | |
|---|---|---|---|---|---|---|---|---|---|---|---|---|---|---|
| | Ni | Co | Cr | Ta | Al | W | Ti | C | Si | Fe | B | Cb | Mo | Zr |
| 1 | 35 | 35 | 23 | 1 | | 3 | | .25 | .75 | 2 | | | | |
| 2 | 33 | 33 | 23 | 3 | 4 | 3 | | .5 | .75 | | | | | |
| 3 | 33 | 33 | 23 | 3 | 4 | 3 | | .05 | .75 | | | | | |
| 4 | 48 | 19 | 23 | 1.4 | 1.9 | 2.3 | 3.7 | .15 | | | .01 | 1 | | |
| 5 | 60 | 9.5 | 14 | | 3 | 4 | 5 | .17 | | | .015 | | 4 | .015 |

The data presented in the following Tables II, III and IV were generated using directionally solidified, elongated multi-grained test specimens prepared in accordance with the method described in the above-incorporated U.S. Pat. No. 3,897,815, except for alloy Example 5 which was conventionally cast. The composition of Example 2 is representative of the present invention.

As can be seen from the data of Table II, alloy Example 2, within the scope of the present invention, has significantly better stress rupture life than the other examples tested at 2700 psi and 2000° F., typical turbine blade tip conditions. Tables III and IV present hot corrosion and oxidation data showing that the present invention provides an improved combination of strength and resistance to oxidation and corrosion.

TABLE II

| Alloy Example | 2000° F. Stress Rupture Data Life in Hours 2700 psi |
|---|---|
| 1 | 109.2 |
| 2 | 1620* |
| 3 | 8 |
| 4 | 9.3 |
| 5 | 350 |

*Test terminated - Run out

TABLE III

| Alloy Example | 1700° F. Hot Corrosion Data Hours in Test | Avg. Max. Penetration (mils per side) |
|---|---|---|
| 1 | 636 | 20.0 |
| 2 | 636 | 3.3 |
| 3 | 636 | 2.1 |
| 4 | 636 | 4.6 |
| 5 | 700 | 12.0 |
| 2 | 1181 | 6.6 |

TABLE IV

| Alloy Example | 2000° F. Cyclic Oxidation Data Hours in Test | Avg. Max. Penetration (mils per side) |
|---|---|---|
| 1 | 585 | 6.6 |
| 2 | 777 | 17.0 |
| 2 | 985 | 17.9 |
| 3 | 785 | 20.4 |
| 4 | 308 | 7.5 |
| 5 | 700 | 19.0 |

As was mentioned before, the alloy of the nominal composition of alloy Example 2, and in the form of a directionally solidified cast structure, including elongated grains and preferably a single crystal, is particularly useful when bonded to the tip of a gas turbine engine turbine blade. Such bonding has been accomplished in the manner described in U.S. Pat. No. 3,632,319, issued Jan. 4, 1972, using such bonding materials as are described in U.S. Pat. Nos. 3,700,427 and 3,759,692 issued Oct. 24, 1972 and Sept. 18, 1973, respectively. The disclosure of each of these three patents is incorporated herein by reference.

Comparisons of the compositions in Table I with the data in Tables II, III and IV show the existence of critical composition limits associated with the present invention. For example, Ni at 35 wt. % or more does not provide adequate strength and the effect of C is significant on such stress rupture properties. The balance of Ni, Co and Cr with the other alloying elements is shown to be critical to provide the desired combination of properties unexpected from some of such relatively small variations: Example 1 has good oxidation resistance but poor corrosion resistance and strength; Example 4 has good corrosion and oxidation resistance but poor strength; Example 3 is very weak; and Example 5 is relatively weak with unacceptable oxidation and corrosion resistance for uncoated turbine blade tip applications.

Thus, the present invention provides an improved alloy composition capable of use as a directionally solidified cast article, particularly as the tip of a turbine blade. Although the present invention has been described in connection with specific examples and embodiments, it will be recognized by those skilled in the art the variations and modifications of which the invention is capable.

What is claimed is:

1. An improved casting alloy consisting essentially of, by weight, 32–34% Ni, 32–34% Co, 22–24% Cr, 2.5–3.5% Ta, 3.5–4.5% Al, 2.5–3.5% W, 0.4–0.5% C, 0.6–0.9% Si and up to 0.1% La, along with incidental impurities.

2. The alloy of claim 1 consisting nominally, by weight, of 33% Ni, 33% Co, 23% Cr, 3% Ta, 4% Al, 3% W, 0.5% C, and 0.75% Si, along with incidental impurities.

3. A cast article of the alloy of claim 1 having a directionally oriented crystal structure.

4. The article of claim 3 in which the structure is a single crystal.

5. An improved gas turbine engine blade having a body of a superalloy based on an element selected from the group consisting of Co and Ni and a tip portion comprising the article of claim 3, connected to the body.

6. The turbine blade of claim 5 in which the blade body is a nickel-base superalloy and the blade tip is a monocrystal structure.

* * * * *